US008864524B2

(12) United States Patent
Sato

(10) Patent No.: US 8,864,524 B2
(45) Date of Patent: Oct. 21, 2014

(54) CONNECTOR

(75) Inventor: Yuzo Sato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 34 days.

(21) Appl. No.: 13/615,546

(22) Filed: Sep. 13, 2012

(65) Prior Publication Data

US 2013/0095687 A1 Apr. 18, 2013

(30) Foreign Application Priority Data

Oct. 13, 2011 (JP) ..... 2011-225548

(51) Int. Cl.
*H01R 12/00* (2006.01)

(52) U.S. Cl.
USPC ..... 439/630; 439/862

(58) Field of Classification Search
USPC ..... 439/66, 81, 82, 83, 91, 247, 591, 630
See application file for complete search history.

(56) References Cited

U.S. PATENT DOCUMENTS 5,009,606 A * 4/1991 Villeneuve et al. ..... 439/59
5,152,695 A * 10/1992 Grabbe et al. ..... 439/71
6,607,404 B1 * 8/2003 Ito et al. ..... 439/630
6,685,512 B2 * 2/2004 Ooya ..... 439/630
6,926,536 B2 * 8/2005 Ochiai ..... 439/66
7,909,657 B1 * 3/2011 Abughazaleh et al. ..... 439/676
8,079,876 B2 * 12/2011 Wang et al. ..... 439/630
8,357,017 B2 * 1/2013 Xu et al. ..... 439/862
8,599,103 B2 * 12/2013 Fukuchi et al. ..... 343/906
8,690,613 B2 * 4/2014 Yoshida et al. ..... 439/862
2006/0009080 A1 * 1/2006 Regnier et al. ..... 439/637

FOREIGN PATENT DOCUMENTS

JP 10-032031 A 2/1998

* cited by examiner

*Primary Examiner* — Neil Abrams
*Assistant Examiner* — Phuongchi T Nguyen
(74) *Attorney, Agent, or Firm* — Holtz Holtz Goodman & Chick PC

(57) ABSTRACT

A connector capable of improving the durability and the contact reliability of a contact. In the contact, a pair of spring portions for pressing a contact portion against a card-type electronic component are formed continuous with the contact portion that is brought into contact with the card-type electronic component. A holding portion held by a housing is formed continuous with the spring portions A connection portion connected to a printed board is formed continuous with the holding portion. The spring portions are made elastically deformable independently of each other, and are bent such that part and the other part of each spring portion do not interfere with each other in a direction of height of the housing when the spring portion is elastically deformed.

24 Claims, 30 Drawing Sheets

CONNECTOR

BACKGROUND OF THE INVENTION

1. Field of the Invention

This invention relates to a connector.

2. Description of the Related Art

Conventionally, as shown in FIG. 28, there has been proposed a connector 901 including an insulator 903 and contacts 910 held by the insulator 903 (see Japanese Patent Laid-Open Publication No. H10-32031 (Paragraphs [0015], [0022], [0023] and [0025], FIGS. 1, 2, 3, 4, etc.). Note that FIGS. 28, 29 and 30 correspond to FIGS. 1, 2 and 4 in Japanese Patent Laid-Open Publication No. H10-32031, respectively. However, in FIGS. 28, 29 and 30, reference numerals are changed, and some of them are deleted.

Each contact 910 includes a contact board 911, a holding board 913, and a terminal portion 915. The contact board 911 extends toward a fitting hole 903*d* of the insulator 903. The holding board 913 is held by a bottom portion 903*b* of the insulator 903. The terminal portion 915 extends out of the insulator 903.

The contact board 911 includes first, second and third contact spring portions 917*a*, 917*b* and 917*c*. The first, second and third contact spring portions 917*a*, 917*b* and 917*c* are arranged in parallel, as shown in FIGS. 29 and 30. The first, second and third contact spring portions 917*a*, 917*b* and 917*c* include first, second and third contact points 918*a*, 918*b* and 918*c*, respectively. The positions of the first and second contact points 918*a* and 918*b* are longitudinally displaced from the position of the third contact point 918*c*.

When the connector 901 is inserted into a mating connector 930, first, the first and second contact points 918*a* and 918*b* of the connector 901 are brought into contact with a mating contact board 936 of a mating contact 934 of the mating connector 930, and then the third contact point 918*c* of the connector 901 is brought into contact with the mating contact board 936 of the mating contact 934 of the mating connector 930.

In the conventional connector 901, as described above, the first, second and third contact spring portions 917*a*, 917*b* and 917*c* include the first, second and third contact points 918*a*, 918*b* and 918*c*, respectively, and have simple linear shapes, and hence the amount of elastic displacement thereof is not large. Therefore, for example, when the manufacturing accuracy of the connector 901 or the mating connector 930 is low, there is a fear that no contact stability can be ensured since predetermined contact forces of the first, second and third contact points 918*a*, 918*b* and 918*c* sometimes are not obtained.

Further, assuming that the conventional connector 901 is forcibly inserted diagonally into a mating fitting portion 934*a* of the mating connector 930, the first, second and third contact points 918*a*, 918*b* and 918*c* can hardly be displaced in the direction of arrangement of the first, second and third contact spring portions 917*a*, 917*b* and 917*c*, and hence, the first, second and third contact points 918*a*, 918*b* and 918*c* cannot follow the diagonal movement of the connector 901. As a consequence, there is a fear that fixed ends of the first, second and third contact spring portions 917*a*, 917*b* and 917*c* via which the contact board 911 continues to the holding board 913 are plastically deformed.

SUMMARY OF THE INVENTION

The present invention has been made in view of these circumstances, and an object thereof is to provide a connector which is capable of improving the durability and the contact reliability of a contact.

To attain the above object, the present invention provides a connector for electrically connecting a first object to be connected and a second object to be connected, comprising a housing in which the first object to be connected is to be disposed, and a contact held by the housing, the contact including a contact portion brought into contact with the first object to be connected, a pair of spring portions that are directly or indirectly continuous with the contact portion, for use in pressing the contact portion against the first object to be connected, a holding portion continuous with the pair of spring portions, for being held by the housing, and a connection portion continuous with the holding portion, for being connected to the second object to be connected, the pair of spring portions being elastically deformable independently of each other, and each spring portion extending, while being bent, in a direction orthogonal to a direction of height of the housing, such that when the spring portion is elastically deformed, part and the other part of the spring portion do not interfere with each other in the direction of the height of the housing.

Preferably, the pair of spring portions are both curved through approximately 180 degrees.

Preferably, the pair of spring portions are both curved through approximately 90 degrees.

Preferably, the housing has a bottom portion opposed to a disposing surface of the first object to be connected; the bottom portion is formed with an accommodating portion for accommodating the pair of spring portions in a displaceable manner; when the first object to be connected is not disposed on the bottom portion, the contact portion protrudes from the accommodating portion, whereas when the first object to be connected is disposed on the bottom portion, the contact portion is pushed in toward the accommodating portion; and when the first object to be connected is disposed on the bottom portion, thereby causing the first object to be connected to be brought into contact with the contact portion to elastically deform the pair of spring portions, the pair of spring portions are not brought into contact with the first object to be connected.

More preferably, the accommodating portion is a hole extending through the bottom portion in the direction of the height of the housing, and when the first object to be connected is disposed on the bottom portion, thereby causing the first object to be connected to be brought into contact with the contact portion to elastically deform the pair of spring portions, the pair of spring portions are not brought into contact with the second object to be connected.

More preferably, the contact portion is located in one area on one side of a plane, as a boundary, which extends through a holding portion-side end of one of the pair of spring portions and a holding portion-side end of the other of the pair of spring portions and is parallel with the direction of the height of the housing, and curved portions of the pair of spring portions are located in the other area on the other side of the plane, such that the curved portions of the pair of spring portions are lifted toward the first object to be connected when the first object to be connected is disposed on the bottom portion, thereby causing the first object to be connected to be brought into contact with the contact portion to elastically deform the pair of spring portions.

Preferably, the first object to be connected is a card-type electronic component, and the second object to be connected is a substrate.

According to the present invention, it is possible to improve the durability and the contact reliability of the contact.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

First, a first embodiment of the present invention will be described with reference to FIGS. 1 to 23.

Figure 1:
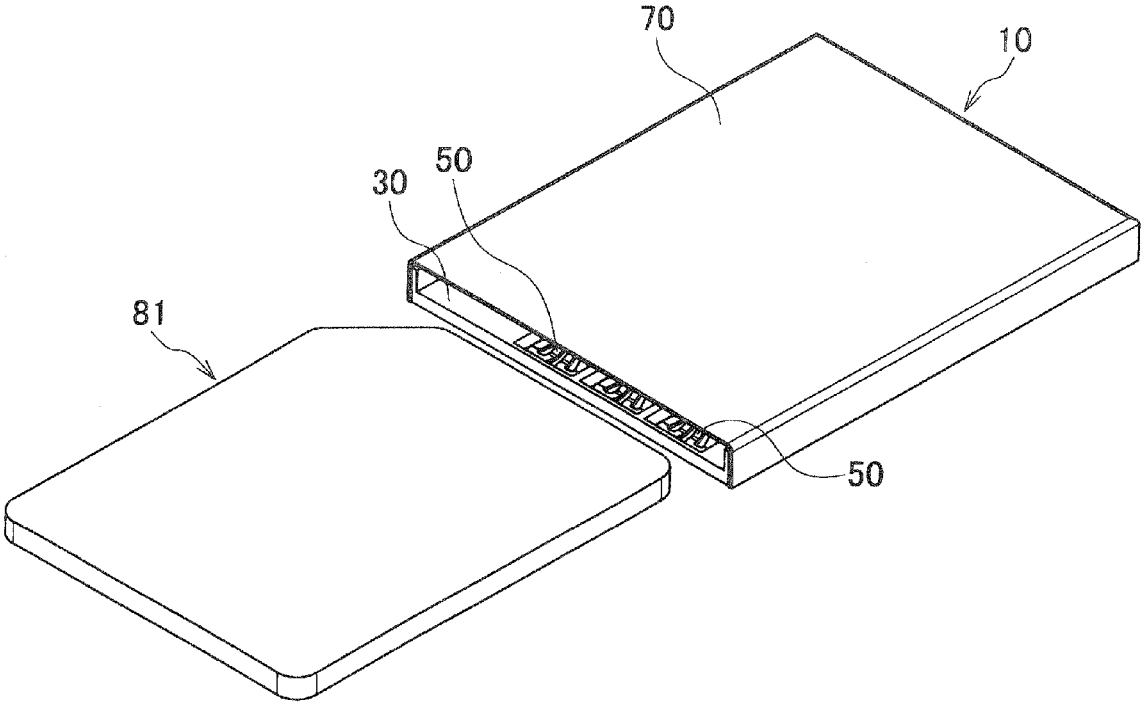
FIG. 1 is a perspective view of a connector according to a first embodiment of the present invention in a state before insertion of a card-type electronic component.
Figure 2:
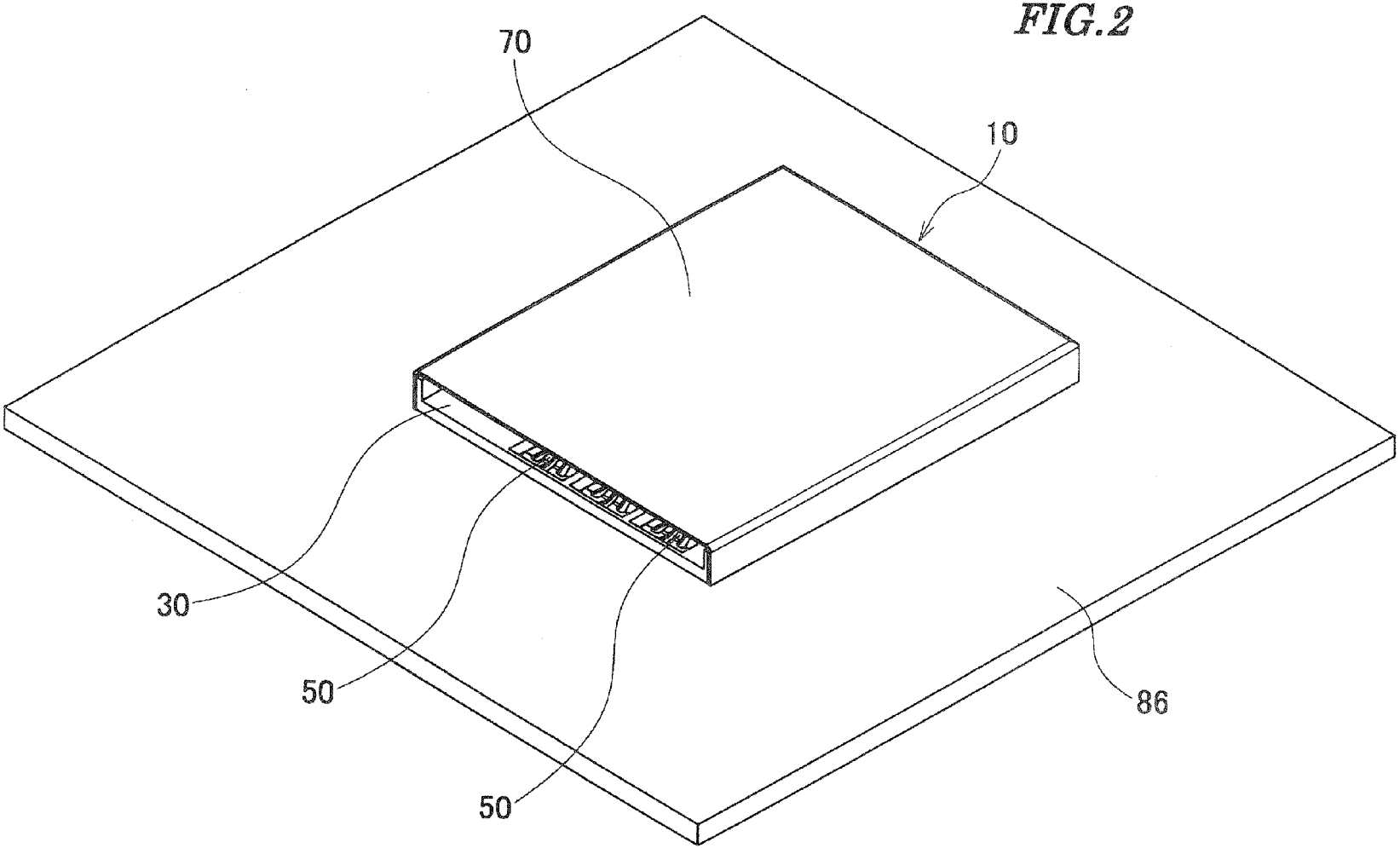
FIG. 2 is a perspective view of the connector shown in FIG. 1 in a state in which the connector is mounted on a printed board.
Figure 3:
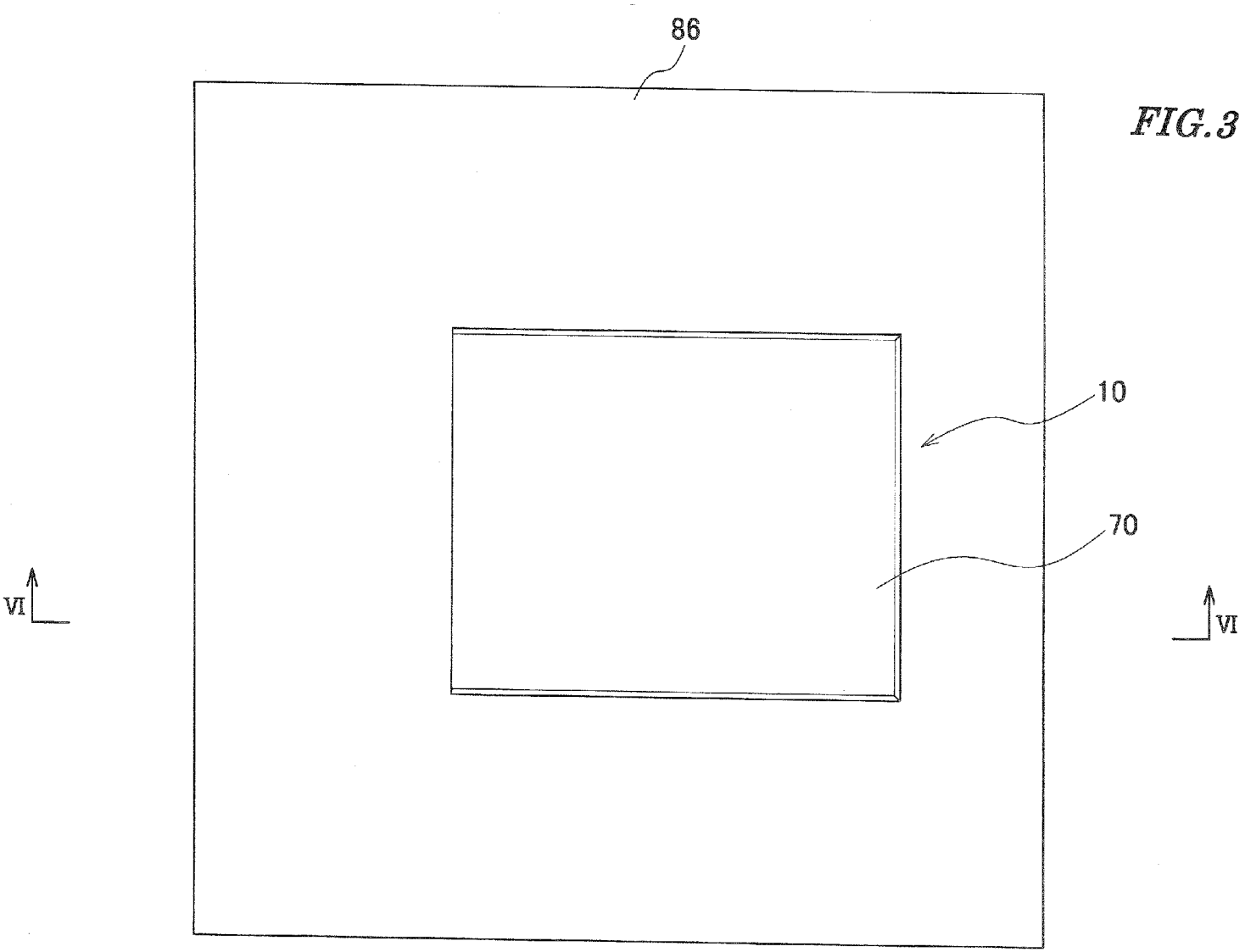
FIG. 3 is a plan view of the connector shown in FIG. 1.

As shown in FIGS. 1 to 3, a connector 10 electrically connects between a card-type electronic component (first object to be connected) 81 and a printed board (second object to be connected) 86.

The connector 10 includes a housing 30, six contacts 50 and a cover 70.

Figure 4:
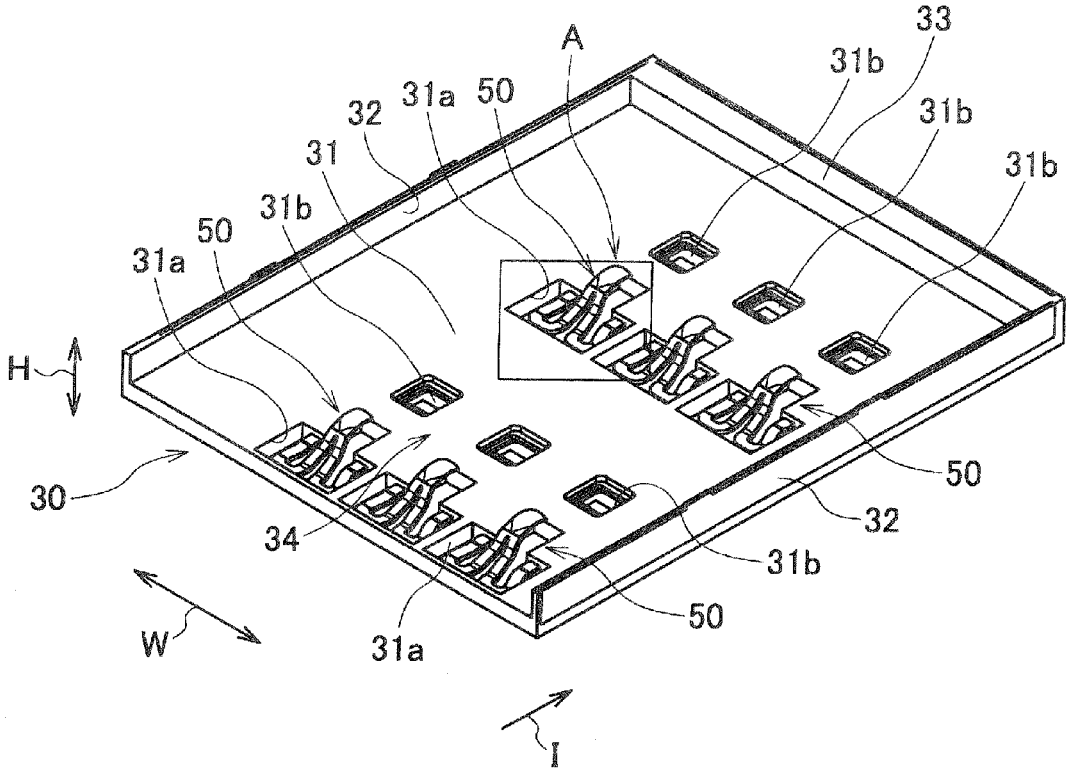
FIG. 4 is a perspective view of the connector shown in FIG. 1 in a state in which a cover is removed therefrom.
Figure 5:
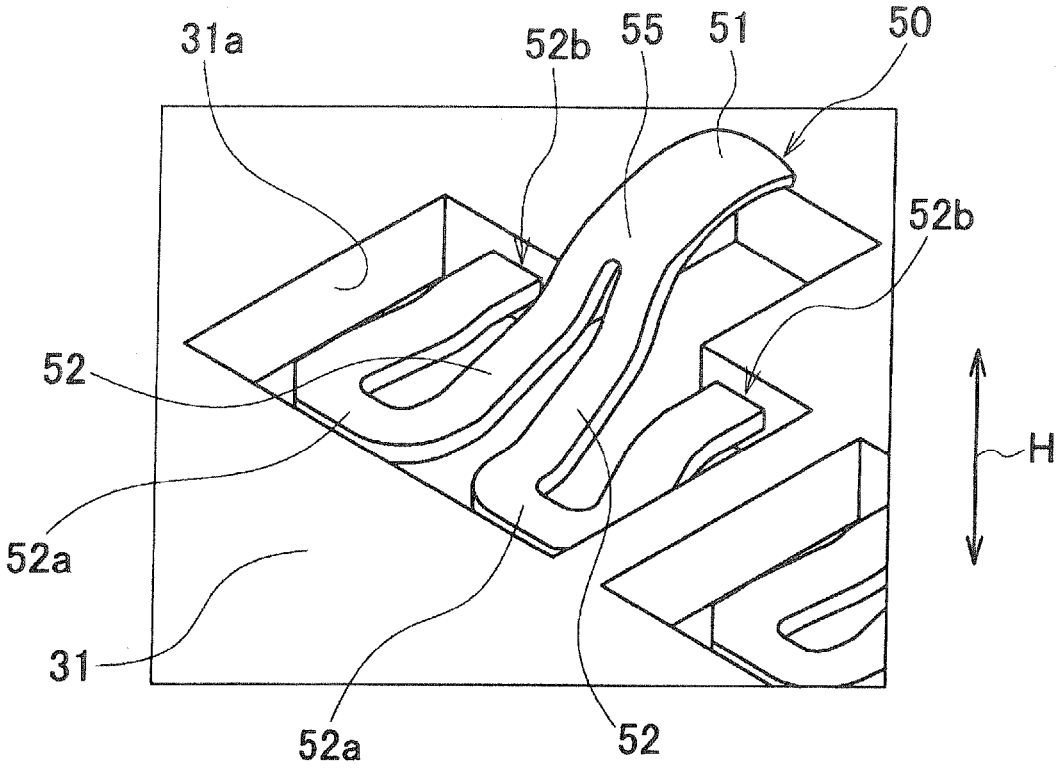
FIG. 5 is a perspective view of part A in FIG. 4.

As shown in FIG. 4, the housing 30 is box-shaped with a front portion and an upper portion thereof opened, and includes a bottom portion 31, two side wall portions 32, and a rear wall portion 33. The bottom portion 31 is flat, and the card-type electronic component 81 is disposed on the bottom portion 31. The bottom portion 31 is opposed to a disposing surface 82 of the card-type electronic component 81 (see FIG. 19). The bottom portion 31 is formed with six accommodating portions 31*a*. The accommodating portions 31*a* are through holes extending through the bottom portion 31 in a direction H of height of the housing 30. The six accommodating portions 31*a* are arranged in two rows at equally-spaced intervals along a direction W of width of the housing. Further, the bottom portion 31 is formed with six holes 31*b*. The holes 31*b* extend through the bottom portion 31 in the direction H of the height of the housing 30. The six holes 31*b* are arranged in two rows at equally-spaced intervals along the direction W of the width of the housing. The six holes 31*b* are located rearward of the accommodating portions 31*a*. Note that in FIGS. 6 and 7, the right side of the connector 10 corresponds to the rear side thereof, and the left side of the connector 10 corresponds to the front side thereof.

The side wall portions 32 are continuous with opposite lateral ends of the bottom portion 31, respectively. The rear wall portion 33 is continuous with a rear end of the bottom portion 31. The bottom portion 31, the side wall portions 32, and the rear wall portion 33 form an accommodation space 34 for accommodating the card-type electronic component 81.

Figure 6:
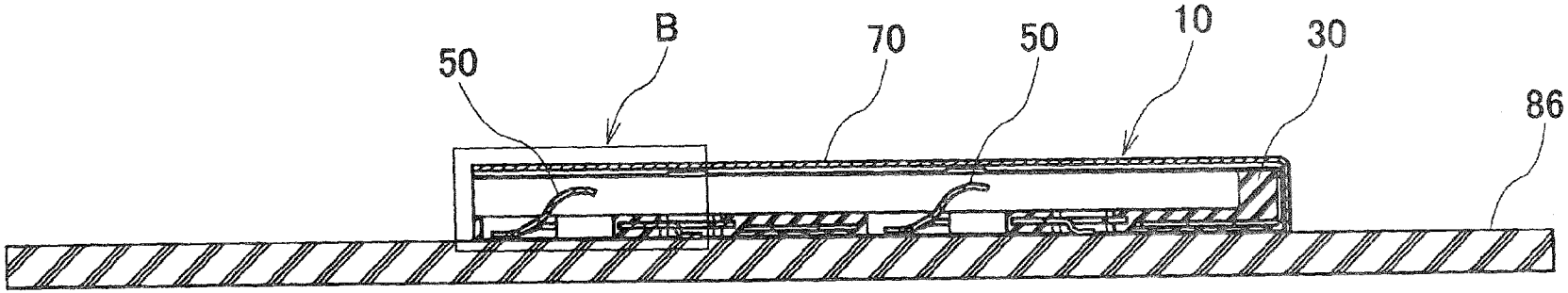
FIG. 6 is a cross-sectional view taken on line VI-VI in FIG. 3.
Figure 7:
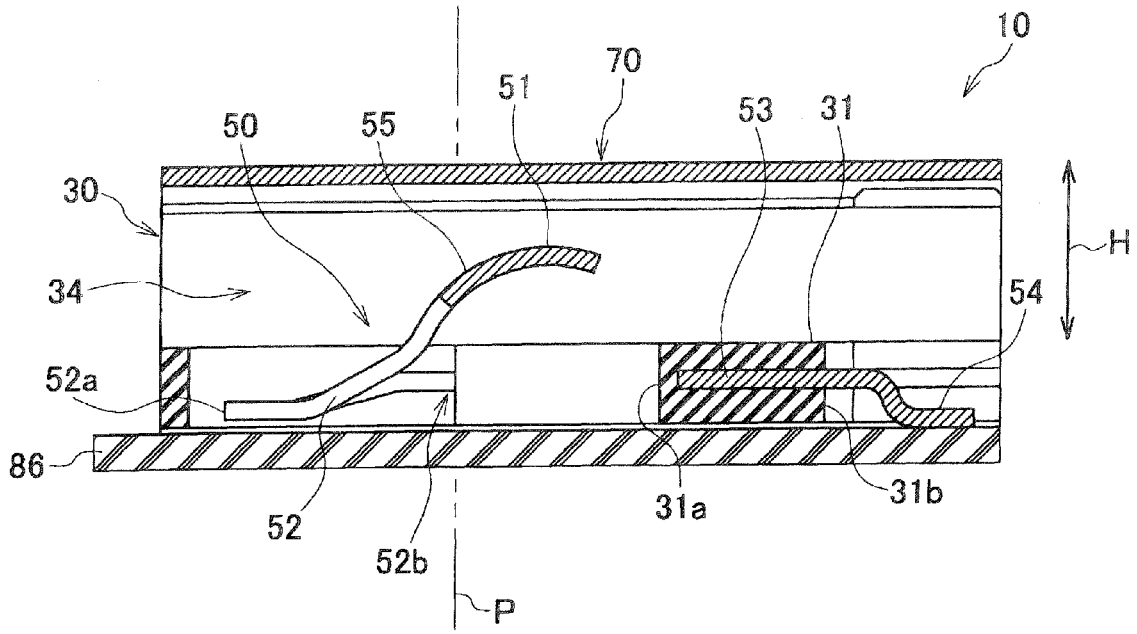
FIG. 7 is an enlarged view of part B in FIG. 6.
Figure 8:
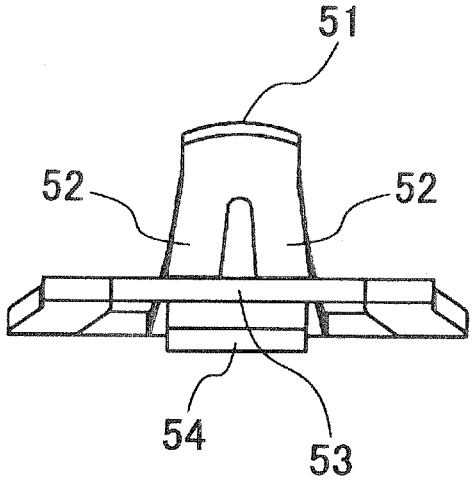
FIG. 8 is a front view of a contact of the connector shown in FIG. 1.
Figure 9:
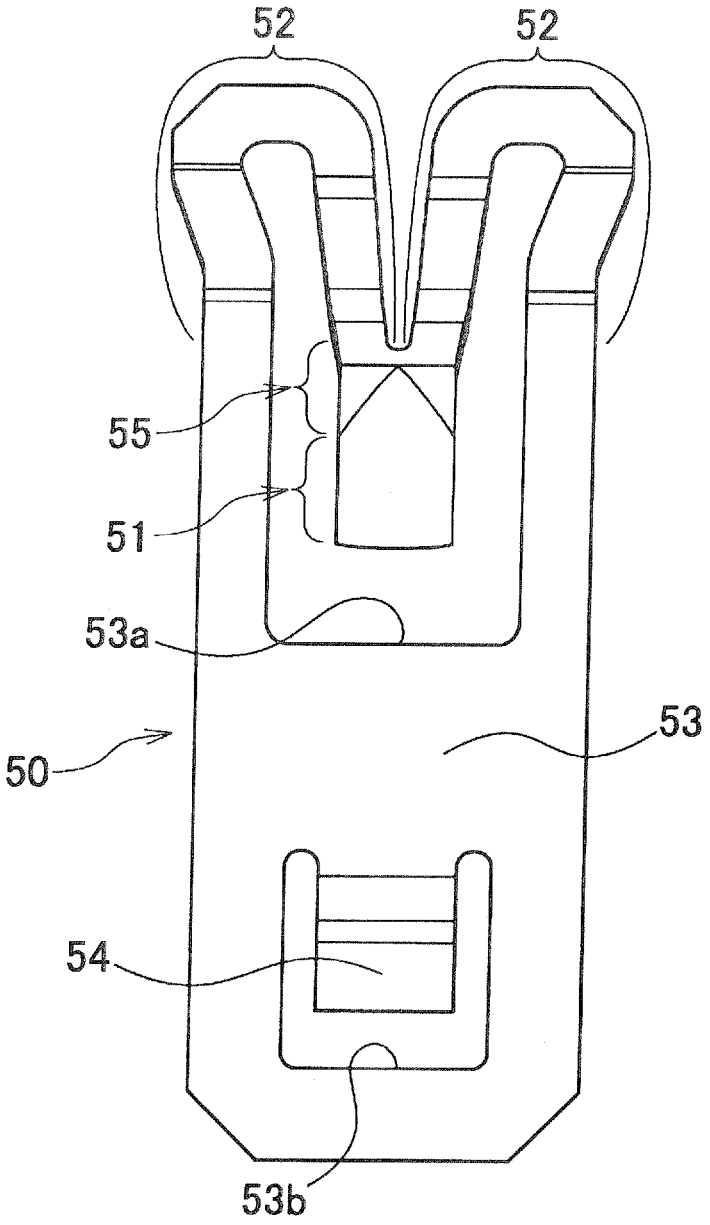
FIG. 9 is a plan view of the contact shown in FIG. 8.
Figure 10:
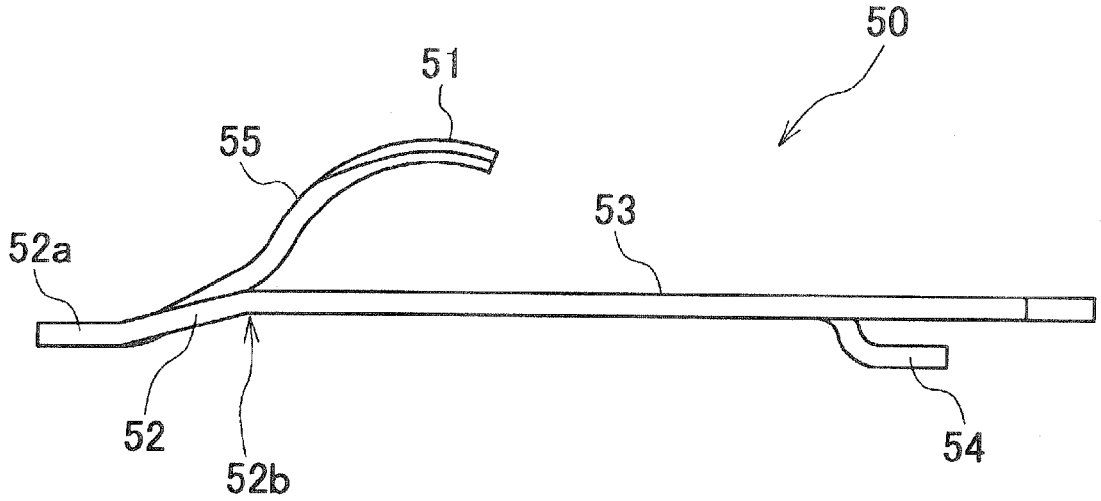
FIG. 10 is a side view of the contact shown in FIG. 8.
Figure 11:
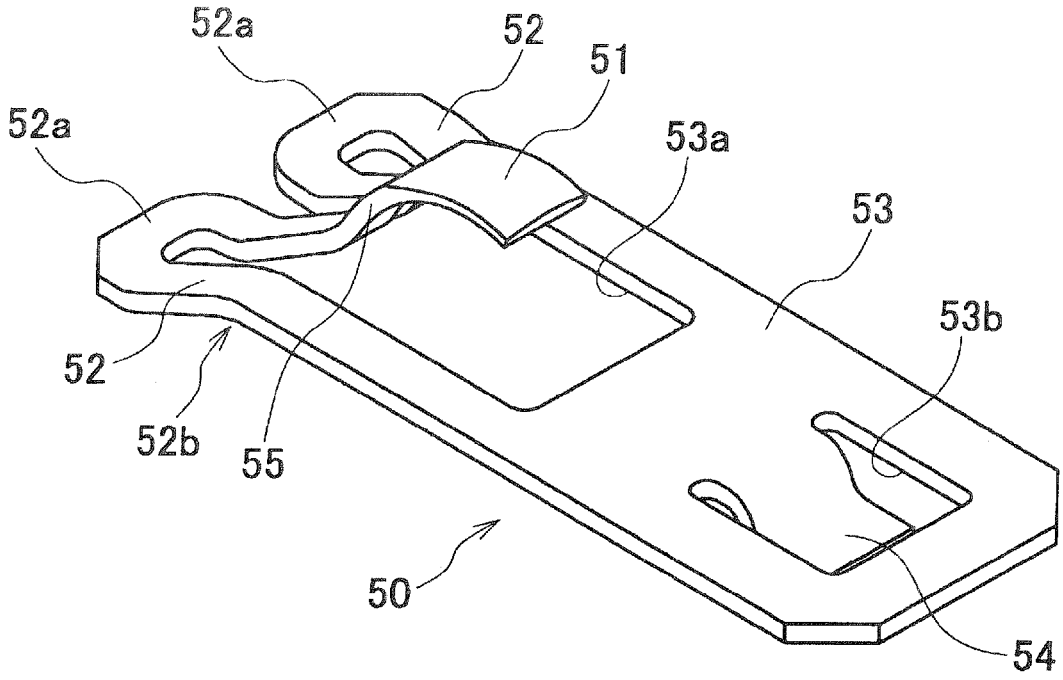
FIG. 11 is a perspective view of the contact shown in FIG. 8, as viewed obliquely from above.
Figure 12:
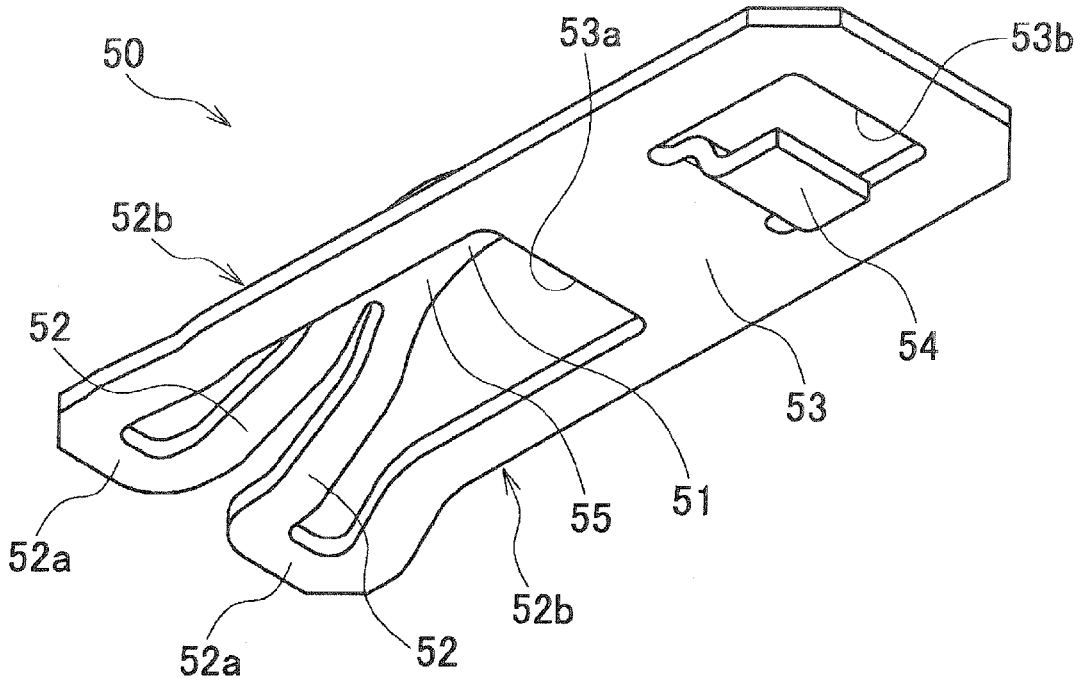
FIG. 12 is a perspective view of the contact shown in FIG. 8, as viewed obliquely from below.
Figure 13:
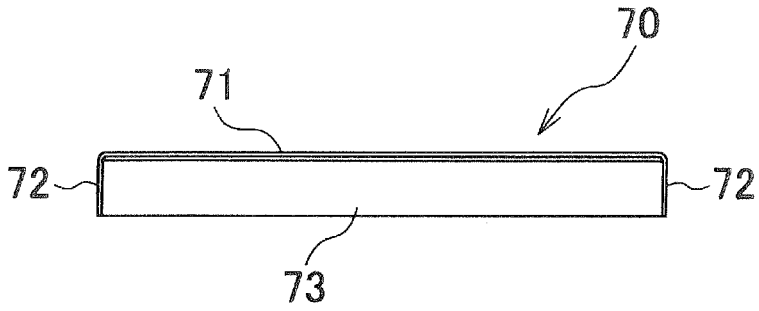
FIG. 13 is a front view of the cover of the connector shown in FIG. 1.
Figure 14:
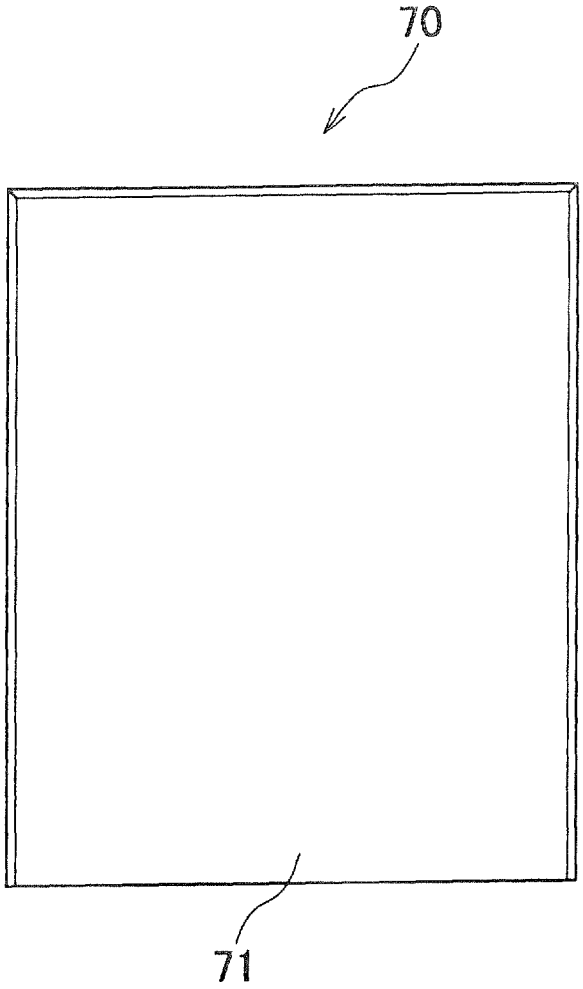
FIG. 14 is a plan view of the cover shown in FIG. 13.
Figure 15:
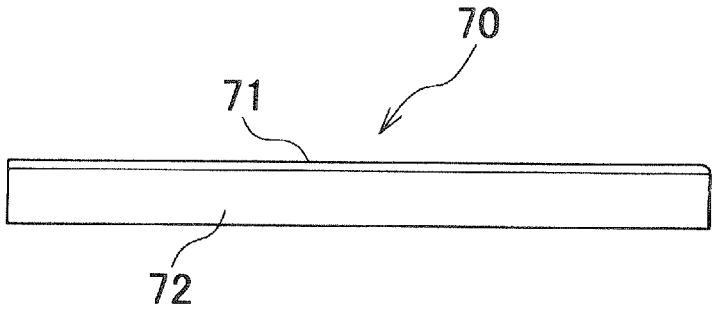
FIG. 15 is a side view of the cover shown in FIG. 13.
Figure 16:
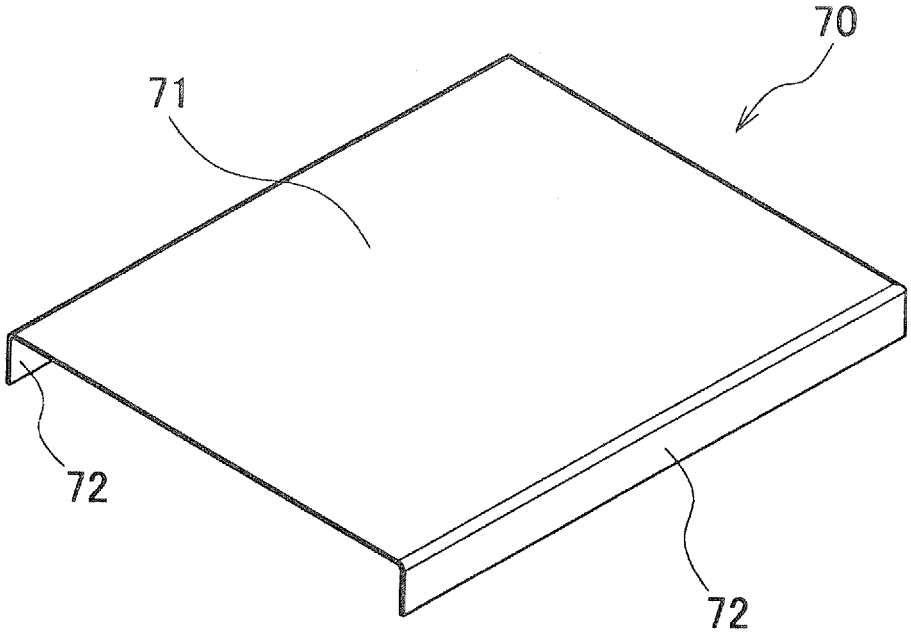
FIG. 16 is a perspective view of the cover shown in FIG. 13, as viewed obliquely from above.
Figure 17:
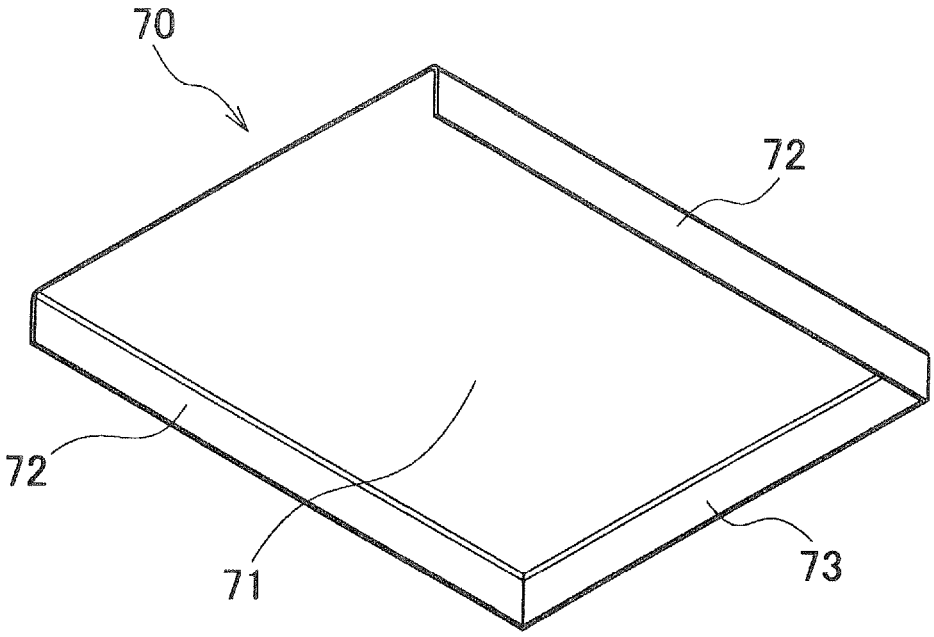
FIG. 17 is a perspective view of the cover shown in FIG. 13, as viewed obliquely from below.
Figure 18:
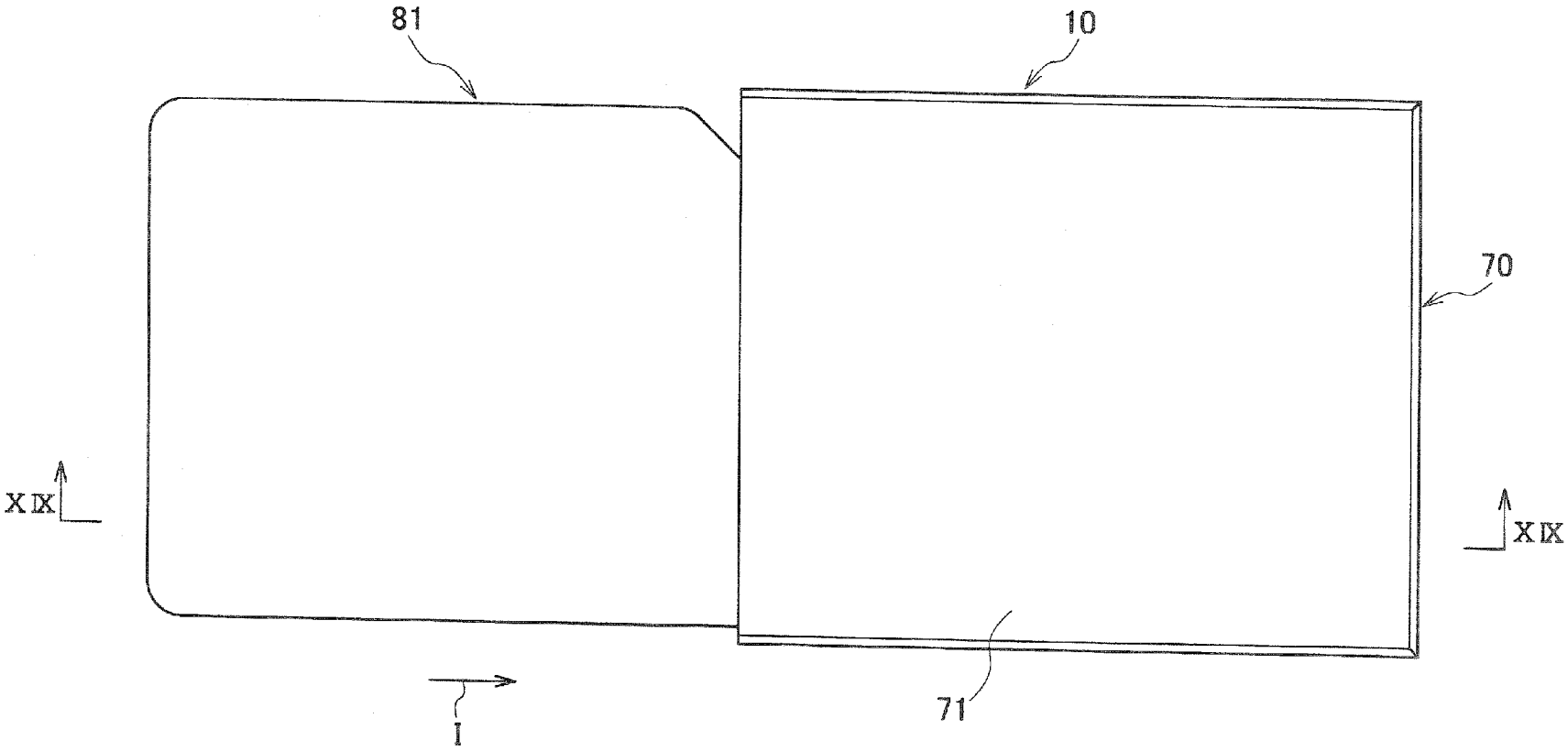
FIG. 18 is a plan view of the connector shown in FIG. 1 in a state in which a front end of the card-type electronic component is inserted therein.
Figure 19:
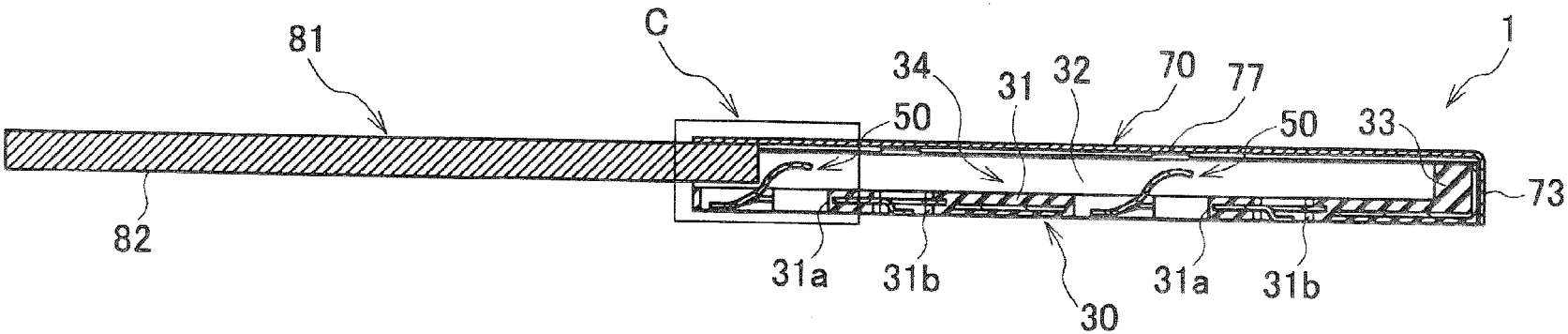
FIG. 19 is a cross-sectional view taken on line XIX-XIX in FIG. 18.
Figure 20:
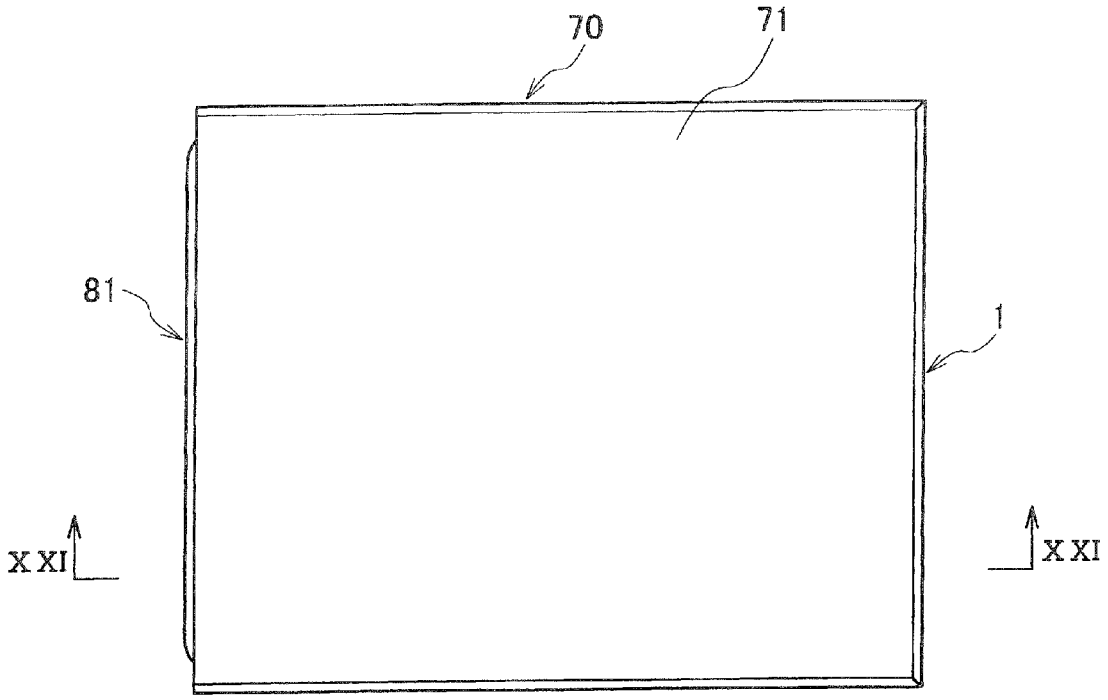
FIG. 20 is a plan view of the connector shown in FIG. 1 in a state in which the card-type electronic component has been inserted therein.
Figure 21:
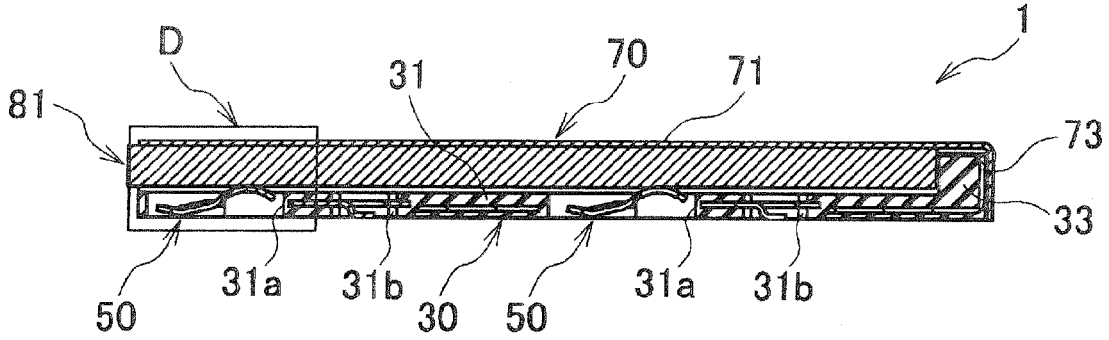
FIG. 21 is a cross-sectional view taken on line XXI-XXI in FIG. 20.

As shown in FIGS. 6 and 7, each contact 50 is held by the housing 30.

Referring to FIGS. 8 to 12, the contact 50 comprises a contact portion 51, a pair of spring portions 52, a holding portion 53, a connection portion 54, and a linking portion 55. The contact 50 is formed by blanking and bending a metal plate.

The contact portion 51 has a substantially arcuate cross-section (see FIG. 7), and is brought into contact with a pad (not shown) of the card-type electronic component 81. When the card-type electronic component 81 is not disposed on the bottom portion 31 of the housing 30, the contact portion 51 protrudes from an associated one of the accommodating portions 31*a*, whereas when the card-type electronic component 81 is disposed on the bottom portion 31, the contact portion 51 is pushed in toward the accommodating portion 31*a* by the card-type electronic component 81. When the contact portion 51 is pushed in toward the accommodating portion 31*a* by the card-type electronic component 81, part of the contact portion 51 is pushed into the accommodating portion 31*a*, but the other part of the contact portion 51 (the top of the contact portion 51) is not pushed into the accommodating portion 31*a* (see FIGS. 22 and 23).

The pair of spring portions 52 press the contact portion 51 against the pad of the card-type electronic component 81. The pair of spring portions 52 are continuous with the contact portion 51 via the linking portion 55. Each spring portion 52 is curved into a U-shape through approximately 180 degrees, as viewed from the direction H of the height of the housing 30. The pair of spring portions 52 are elastically deformable independently of each other. Each spring portion 52 extends, while being bent, in a direction orthogonal to the direction H of the height of the housing 30, such that when the spring portion 52 is elastically deformed, part of the spring portion 52 and the other part thereof do not interfere with each other in the direction H of the height of the housing 30 (see FIGS. 4 and 5). The pair of spring portions 52 are accommodated in the accommodating portion 31*a* such that they are displaceable (see FIGS. 22 and 23).

The holding portion 53, having a substantially plate-like shape, is continuous with the pair of spring portions 52, and is held by the housing 30 (see FIG. 7). The holding portion 53 includes a cutout 53*a* and a hole 53*b*. The cutout 53*a* is for avoiding interference between the holding portion 53 and the contact portion 51. The hole 53*b* is located rearward of the cutout 53*a* (see FIG. 11).

The connection portion 54 is continuous with the holding portion 53. The connection portion 54 is formed by cutting and raising. The connection portion 54 is bent into an L-shape (see FIG. 10). Most part of the connection portion 54 is accommodated in an associated one of the holes 31*b*, and a lower end of the connection portion 54 protrudes downward from the hole 31*b*. The connection portion 54 is soldered to a pad (not shown) of the printed board 86 (see FIG. 7).

The contact portion 51 is located in one area on one side (right side as viewed in FIG. 7) of a plane P, as a boundary, which extends through a holding portion-side end 52*b* (see FIG. 5) of one of the spring portions 52 and a holding portion-side end 52*b* (see FIG. 5) of the other of the spring portions 52 and is parallel with the direction H of the height of the housing 30, and curved portions 52*a* of the pair of spring portions 52 are located in the other area on the other side (left side as viewed in FIG. 7) of the plane P. With this arrangement, when the card-type electronic component 81 is disposed on the bottom portion 31 of the housing 30, and is brought into contact with the contact portion 51, the curved portions 52*a* of the pair of spring portions 52 are displaced upward within the accommodating portion 31*a* (see FIGS. 22 and 23).

As shown in FIGS. 13 to 17, the cover 70 is box-shaped with a front portion and a lower portion opened, and includes a top portion 71, two side wall portions 72, and a rear wall portion 73. The top portion 71 is flat, and covers the top of the housing 30. The side wall portions 72 are continuous with opposite lateral ends of the top portion 71, respectively. The rear wall portion 73 is continuous with a rear end of the top portion 71.

To mount the card-type electronic component 81 on the connector 10, as shown in FIGS. 18 to 21, it is only required to insert the card-type electronic component 81 into the accommodation space 34 of the housing 30 of the connector 10 along a direction I of insertion of the card-type electronic component 81.

Figure 22:
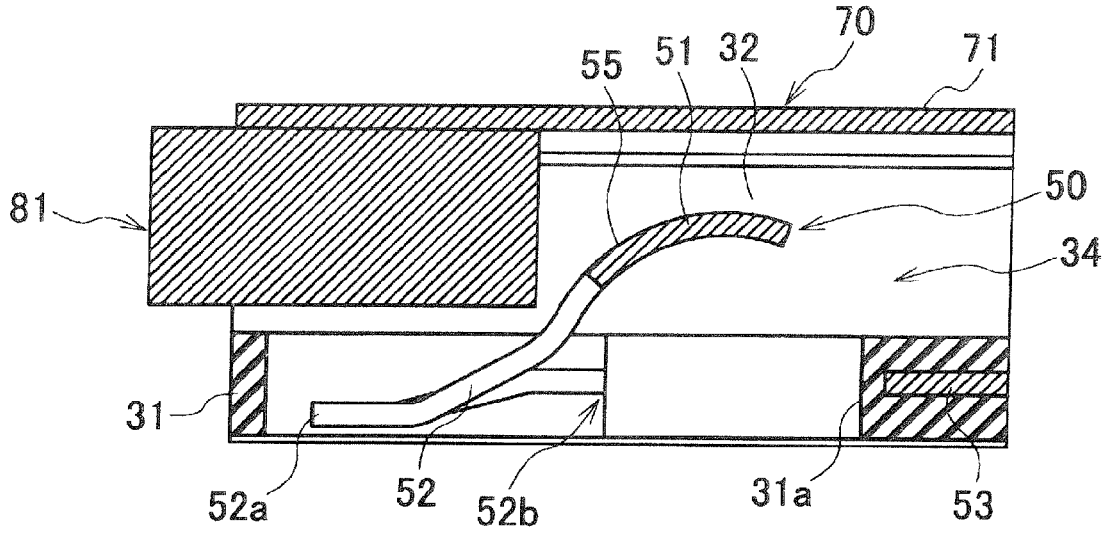
FIG. 22 is an enlarged view of part C in FIG. 19.
Figure 23:
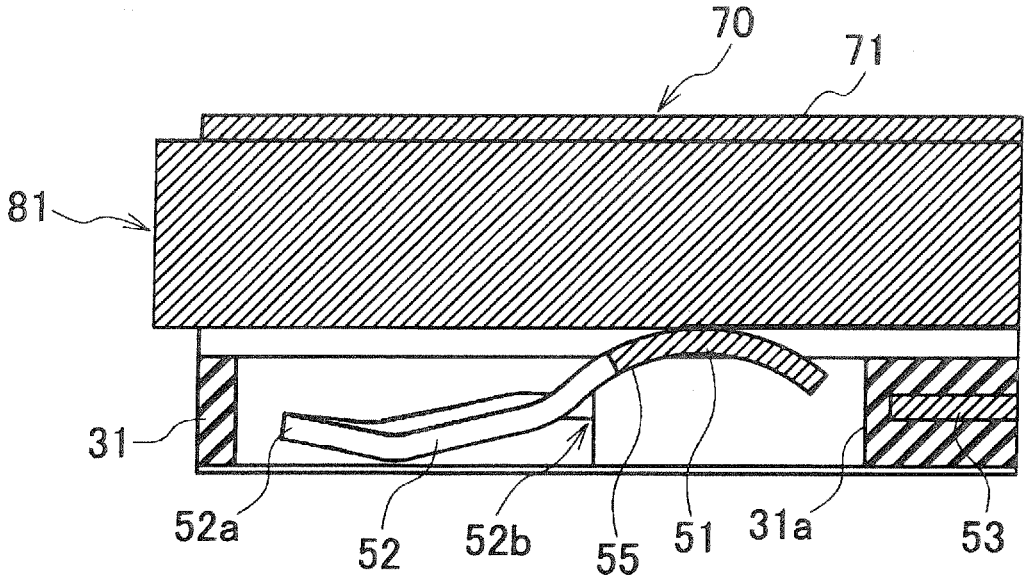
FIG. 23 is an enlarged view of part D in FIG. 21.
Figure 24:
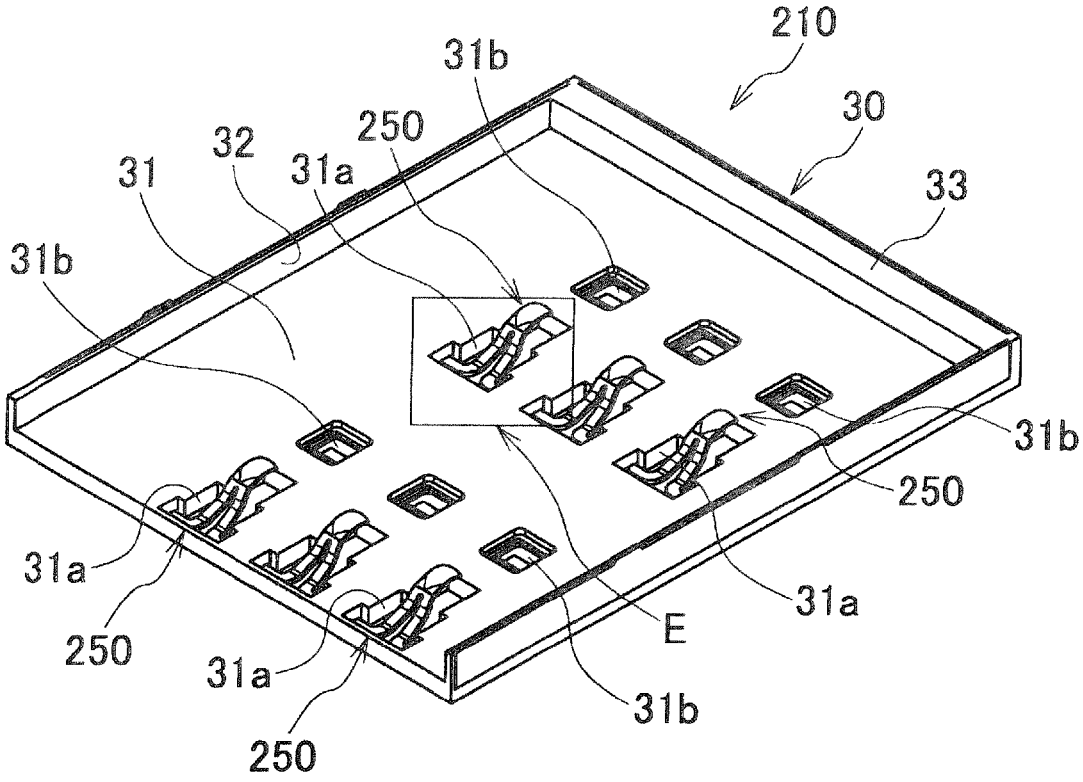
FIG. 24 is a perspective view of a connector according to a second embodiment of the present invention in a state in which a cover is removed therefrom.
Figure 25:
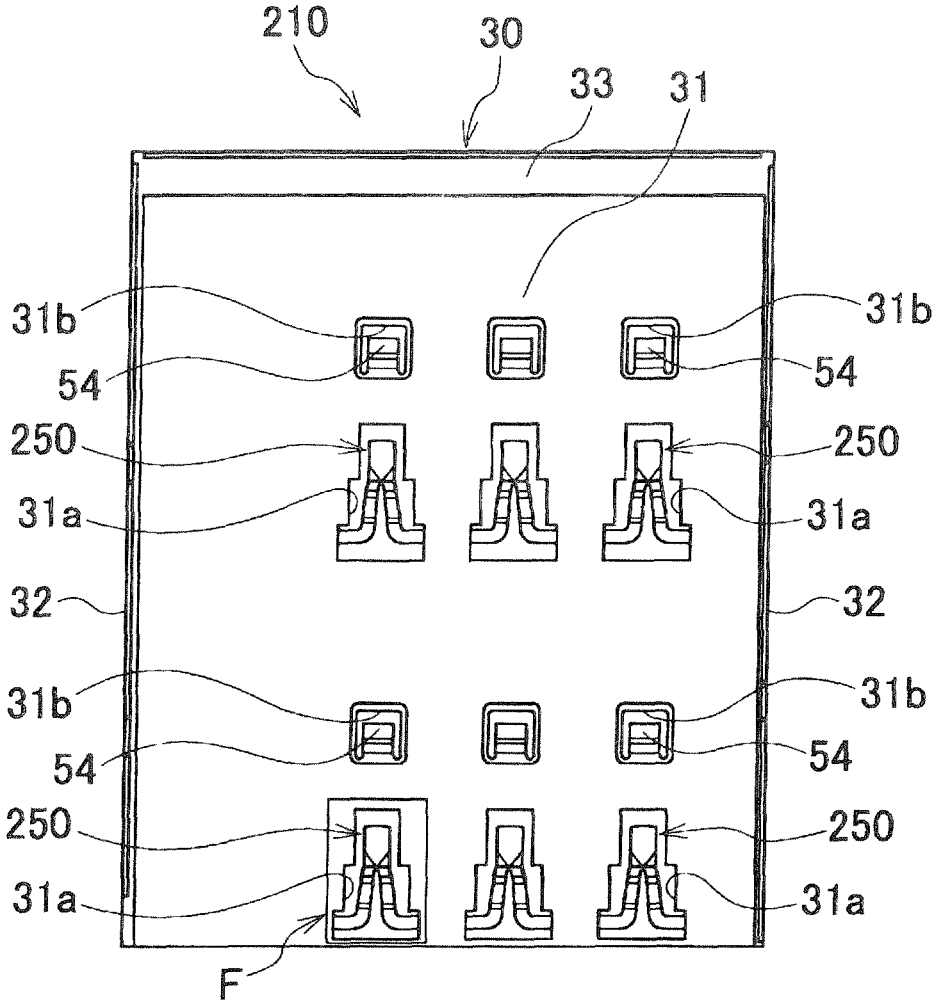
FIG. 25 is a plan view of the connector shown in FIG. 24.
Figure 26:
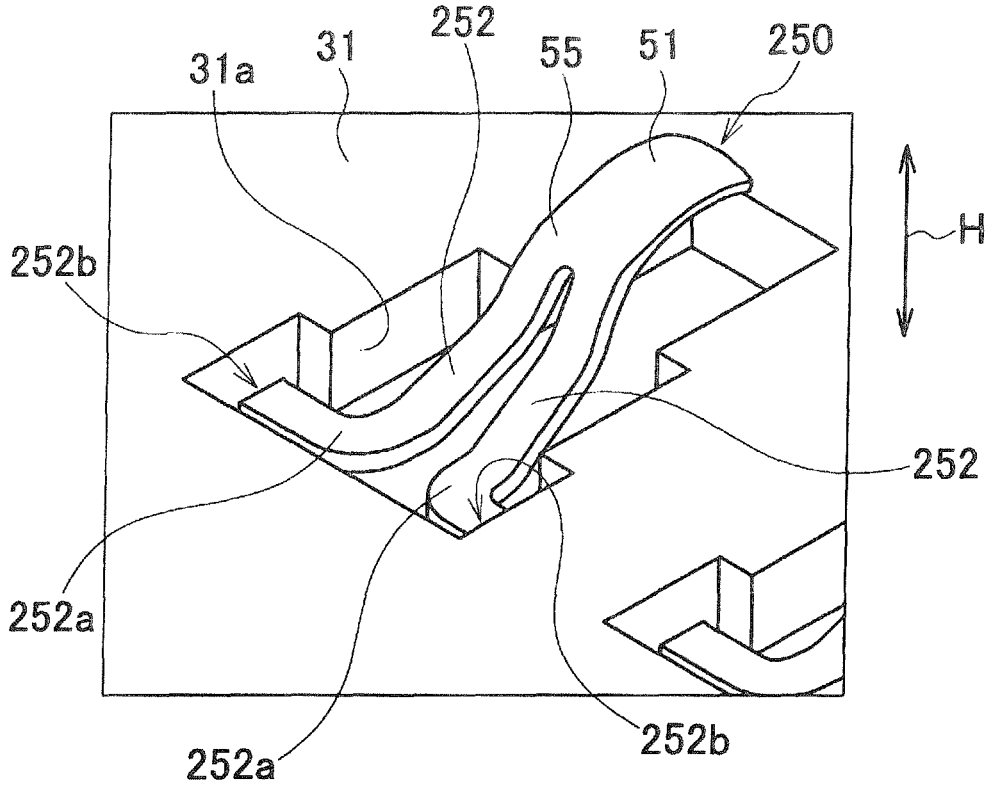
FIG. 26 is an enlarged view of part E in FIG. 24.
Figure 27:
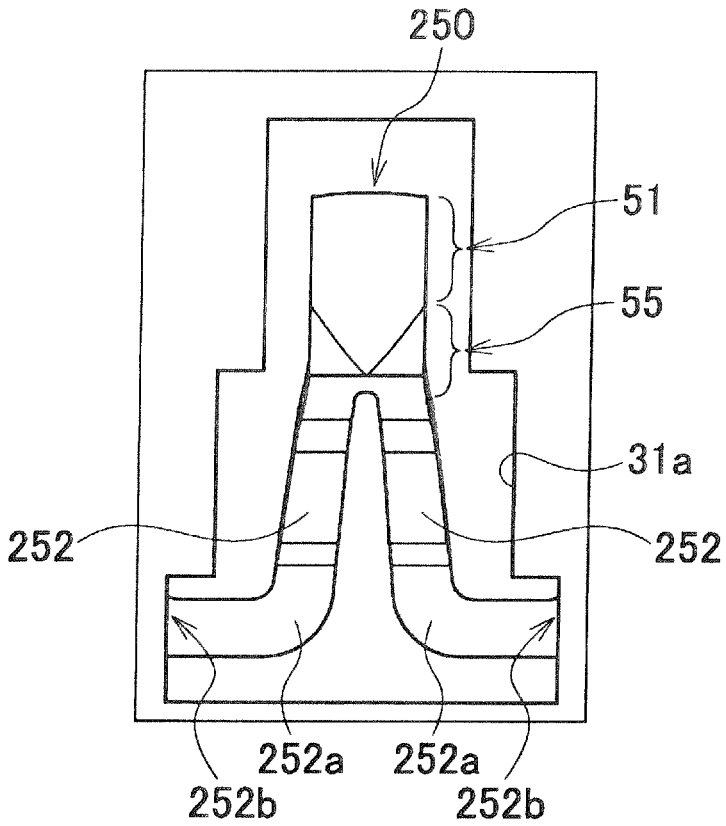
FIG. 27 is an enlarged view of part F in FIG. 25.
Figure 28:
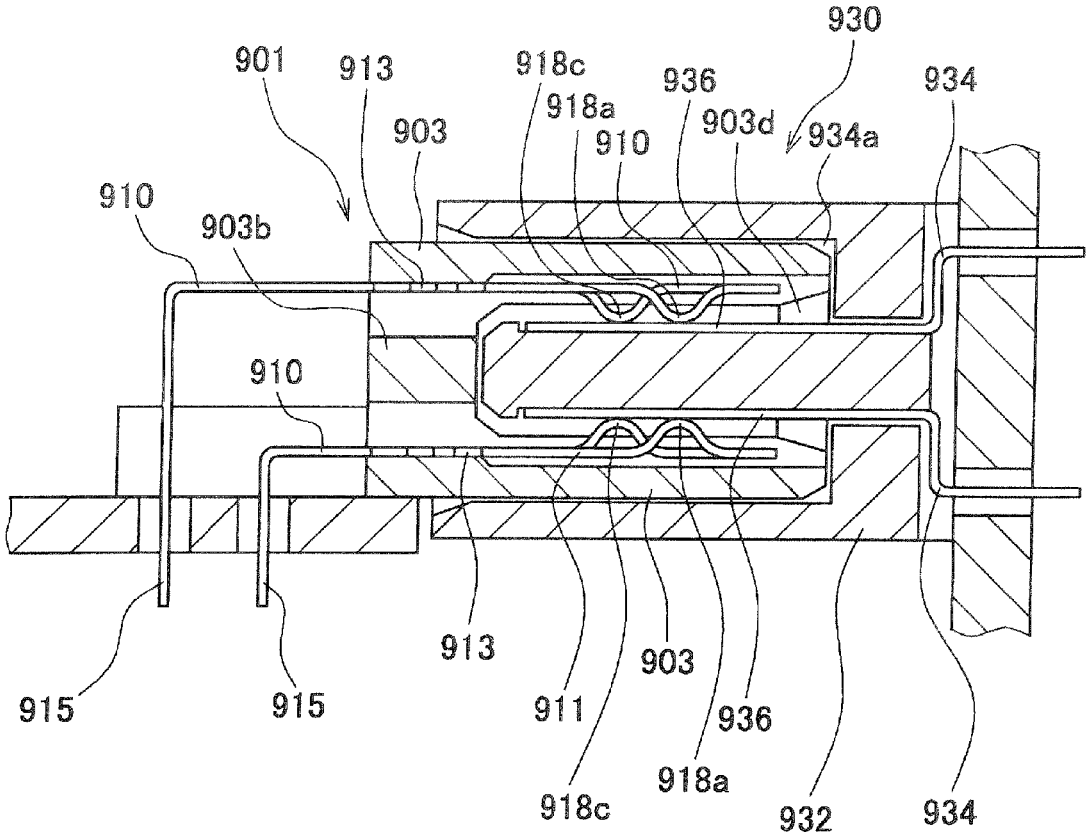
FIG. 28 is a cross-sectional view of a conventional connector including contacts.
Figure 29:
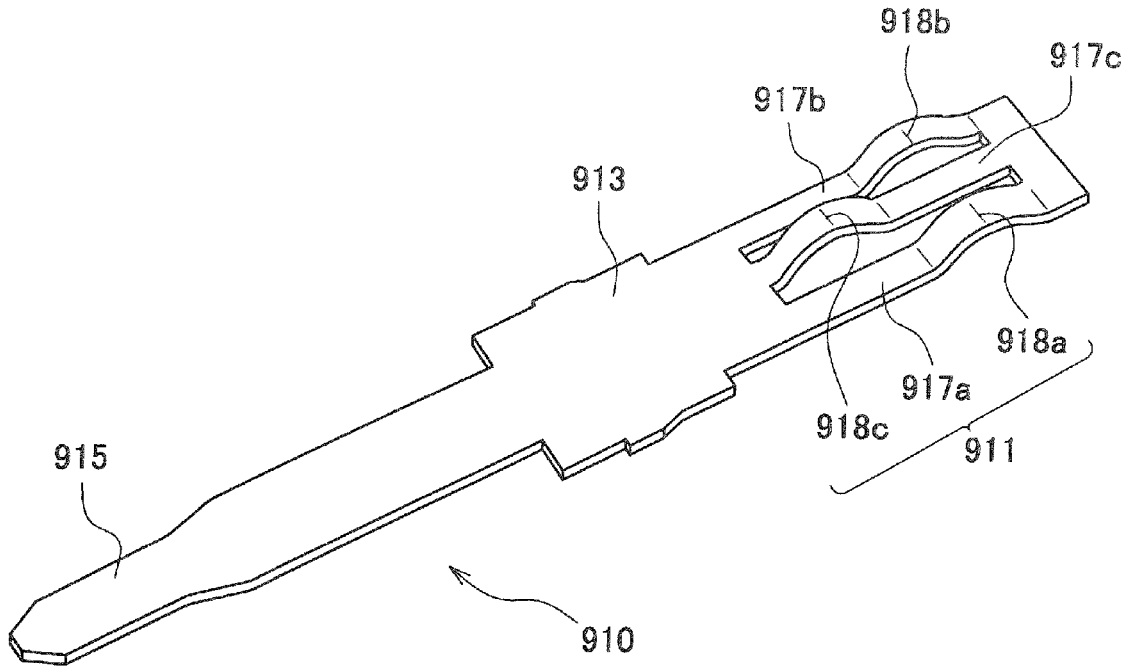
FIG. 29 is a perspective view of one of the contacts shown in FIG. 28, in a state in which a terminal portion thereof is not bent.
Figure 30:
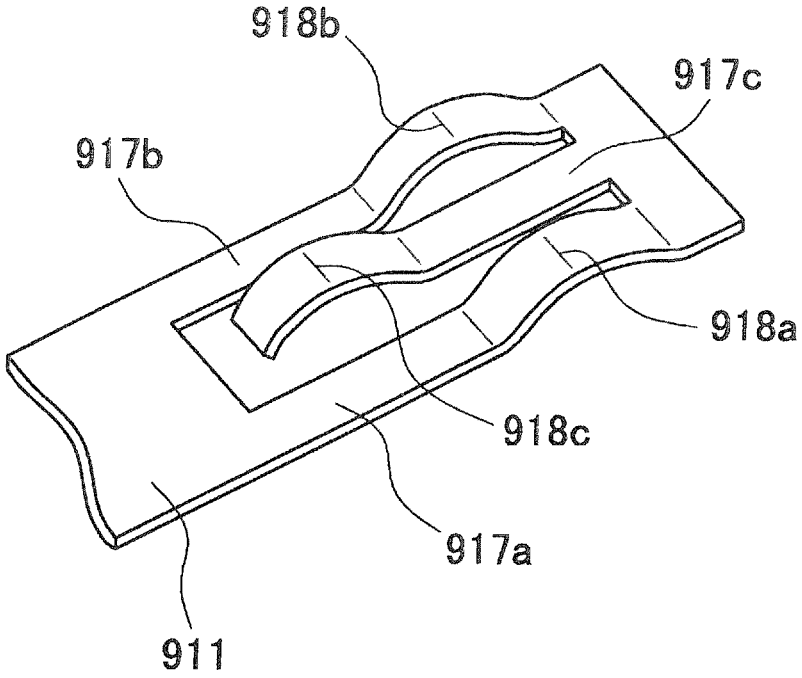
FIG. 30 is a perspective view of a contact board of the contact shown in FIG. 28.

At this time, as shown in FIGS. 22 and 23, the contact portion 51 and the linking portion 55 of the contact 50 are pressed toward the accommodating portion 31*a* by the card-type electronic component 81, whereby the contact portion 51 and the spring portions 52 are displaced downward so that part of the contact portion 51 enters the accommodating portion 31*a*, but the top of the contact portion 51 is located in the accommodation space 34. The spring portions 52 are elastically deformed in accordance with displacement of the contact portion 51 and the linking portion 55 to thereby generate a spring force for pressing the contact portion 51 against the pad of the card-type electronic component 81.

Further, each spring portion 52 is formed to have a U-shape and hence provides a long spring, and when the spring portion 52 is elastically deformed, part and the other part thereof do not interfere with each other, whereby the amount of elastic deformation of the spring portion 52 is not reduced. Furthermore, the spring portion 52 continuous with the contact portion 51 via the linking portion 55 extends, while being bent, in the direction orthogonal to the direction H of the height of the housing 30, which contributes reduction in height of the connector 10.

Further, when the card-type electronic component 81 is disposed on the bottom portion 31 of the housing 30, and is brought into contact with the contact portion 51, the curved portions 52*a* of the pair of spring portions 52 are displaced upward within the accommodating portion 31*a*, which makes it possible to prevent the curved portions 52*a* from being brought into contact with the printed board 86 to cause plastic deformation of the spring portions 52. Further, it is possible to prevent the pad of the printed board 86 and the like from being damaged.

Furthermore, even when the card-type electronic component 81 is forcibly inserted diagonally into the accommodation space 34 of the housing 30 of the connector 10, the pair of spring portions 52 can be elastically deformed independently of each other, and the contact portion 51 moves (follows the elastic deformation) in the direction W of the width of the housing, which makes the spring portions 52 resistant to plastic deformation.

According to the present embodiment, the contact 50 is configured such that each spring portion 52 is curved to increase the length of the spring thereof and part of the spring portion 52 does not interfere with the other part thereof when the spring portion 52 is elastically deformed, so that it is possible to increase the amount of elastic deformation of the spring portion 52, thereby making it possible to improve contact reliability of the contact 50.

Further, the pair of spring portions 52 are elastically deformable independently of each other, and the contact portion 51 can move in the direction W of the width of the housing, and hence even when the card-type electronic component 81 is forcibly inserted diagonally into the accommodation space 34 of the housing 30 of the connector 10, the spring portions 52 are resistant to plastic deformation, whereby the durability of the contact 50 is improved.

Furthermore, since the pair of spring portions 52 of the contact 50 are accommodated in the accommodating portion 31*a*, the connector 10 can be reduced in height compared with a connecter (not shown) which has no accommodating portion 31*a* formed in the bottom portion 31.

Next, a connector according to a second embodiment of the present invention will be described with reference to FIGS. 24 to 27. The same component parts as those of the connector according to the first embodiment are denoted by the same reference numerals, and detailed description thereof is omitted, while only component parts different from those of the first embodiment will be described hereinafter.

The connector 210 according to the second embodiment is distinguished from the connector 10 according to the first embodiment in the shape of spring portions 252 of a contact 250.

A pair of spring portions 252 of the contact 250 are each curved into an L-shape, as viewed from the direction H of the height of the housing 30.

Therefore, in the second embodiment, the contact portion 51 is located in one area on one side of a plane, as a boundary, which extends through a holding portion-side end 252*b* (see FIG. 26) of one of the spring portions 252 and a holding portion-side end 252*b* (see FIG. 26) of the other of the spring portions 252 and is parallel with the direction H of the height of the housing, and curved portions 252*a* of the pair of spring portions 52 are located on the plane parallel with the direction H of the height of the housing. According to this arrangement, when the card-type electronic component 81 is disposed on the bottom portion 31 of the housing 30, and is brought into contact with the contact portion 51, the amount of displacement of the curved portions 252*a* is smaller than that of the curved portions 52*a* of the first embodiment.

The second embodiment provides the same advantageous effects as provided by the first embodiment.

Although in the first embodiment, the spring portion 52 is formed into a U-shape by blanking a metal plate, and in the second embodiment, the spring portion 252 is formed into an L-shape by blanking a metal plate, the shapes of the spring portions 52 and 252 are not limited to these, but they may be formed into a V-shape or a W-shape, for example.

Further, in the first embodiment, the connector is configured such that the curved portions 52*a* of the spring portions 52 are moved upward when the card-type electronic component 81 is inserted into the accommodation space 34 of the housing 30 of the connector 10, causing the contact portion 51 to be brought into contact with the card-type electronic component 81. Further, although in the second embodiment, the connector is configured such that when the card-type electronic component 81 is inserted into the connector 210, causing the contact portion 51 to be brought into contact with the card-type electronic component 81, the amount of displacement of the curved portions 252*a* of the spring portions 252 is smaller than in the first embodiment, the connector 10 is not necessarily required to be thus configured, but is only required to be configured such that the curved portions 52*a* and 252*a* are kept from contact with the card-type electronic component 81 and the printed board 86 when the contact portion 51 is brought into contact with the card-type electronic component 81. For example, the curved portion 52*a* is only required to be kept from contact with the card-type electronic component 81 even when the curved portion 52*a* protrudes upward from the accommodating portion 31*a*.

Note that although in the above-described embodiments, the accommodating portion 31*a* are through holes, they may be bottomed holes (not shown) each having a bottom.

Further, the first object to be connected is not limited to the card-type electronic component 81, but examples of the first object to be connected include electronic components and printed boards, such as camera modules and LED modules, each of which has a flat disposing surface opposed to the bottom portion 31, and examples of the first object to be connected includes an FPC and the like.

Furthermore, although in the above-described embodiments, the spring portions 52 and 252 are indirectly continuous with the contact portion 51 via the linking portion 55, they may be directly continuous with the contact portion 51.

It is further understood by those skilled in the art that the foregoing are the preferred embodiments of the present invention, and that various changes and modification may be made thereto without departing from the spirit and scope thereof.

What is claimed is:

1. A connector for electrically connecting a first object to be connected and a second object to be connected, comprising:

a housing in which the first object to be connected is to be disposed; and a contact held by said housing, said contact including a contact portion to be brought into contact with the first object to be connected, a pair of spring portions that are directly or indirectly continuous with said contact portion, for pressing said contact portion against the first object to be connected, a holding portion continuous with said pair of spring portions, for being held by said housing, and a connection portion continuous with said holding portion, for being connected to the second object to be connected, said pair of spring portions being elastically deformable independently of each other, and each spring portion extending, while being bent, in a direction orthogonal to a direction of height of said housing, such that when said spring portion is elastically deformed, a part of said spring portion and another part of said spring portion do not interfere with each other in the direction of the height of said housing.

2. The connector as claimed in claim 1, wherein the first object to be connected is a card-type electronic component, and the second object to be connected is a substrate.

3. The connector as claimed in claim 1, wherein said pair of spring portions are both curved through approximately 180 degrees.

4. The connector as claimed in claim 3, wherein the first object to be connected is a card-type electronic component, and the second object to be connected is a substrate.

5. The connector as claimed in claim 3, wherein said housing has a bottom portion opposed to a disposing surface of the first object to be connected, wherein said bottom portion is formed with an accommodating portion for accommodating said pair of spring portions in a displaceable manner, wherein when the first object to be connected is not disposed on said bottom portion, said contact portion protrudes from said accommodating portion, whereas when the first object to be connected is disposed on said bottom portion, said contact portion is pushed in toward said accommodating portion, and wherein when the first object to be connected is disposed on said bottom portion, thereby causing the first object to be connected to be brought into contact with said contact portion to elastically deform said pair of spring portions, said pair of spring portions are not brought into contact with the first object to be connected.

6. The connector as claimed in claim 5, wherein the first object to be connected is a card-type electronic component, and the second object to be connected is a substrate.

7. The connector as claimed in claim 5, wherein said accommodating portion is a hole extending through said bottom portion in the direction of the height of said housing, and wherein when the first object to be connected is disposed on said bottom portion, thereby causing the first object to be connected to be brought into contact with said contact portion to elastically deform said pair of spring portions, said pair of spring portions are not brought into contact with the second object to be connected.

8. The connector as claimed in claim 7, wherein the first object to be connected is a card-type electronic component, and the second object to be connected is a substrate.

9. The connector as claimed in claim 7, wherein the contact portion is located in one area on one side of a plane, as a boundary, which extends through a holding portion-side end of one of said pair of spring portions and a holding portion-side end of the other of said pair of spring portions and is parallel with the direction of the height of said housing, and curved portions of said pair of spring portions are located in another area on another side of the plane, such that said curved portions of said pair of spring portions are lifted toward the first object to be connected when the first object to be connected is disposed on said bottom portion, thereby causing the first object to be connected to be brought into contact with said contact portion to elastically deform said pair of spring portions.

10. The connector as claimed in claim 9, wherein the first object to be connected is a card-type electronic component, and the second object to be connected is a substrate.

11. The connector as claimed in claim 1, wherein said pair of spring portions are both curved through approximately 90 degrees.

12. The connector as claimed in claim 11, wherein the first object to be connected is a card-type electronic component, and the second object to be connected is a substrate.

13. The connector as claimed in claim 11, wherein said housing has a bottom portion opposed to a disposing surface of the first object to be connected, wherein said bottom portion is formed with an accommodating portion for accommodating said pair of spring portions in a displaceable manner, wherein when the first object to be connected is not disposed on said bottom portion, said contact portion protrudes from said accommodating portion, whereas when the first object to be connected is disposed on said bottom portion, said contact portion is pushed in toward said accommodating portion, and wherein when the first object to be connected is disposed on said bottom portion, thereby causing the first object to be connected to be brought into contact with said contact portion to elastically deform said pair of spring portions, said pair of spring portions are not brought into contact with the first object to be connected.

14. The connector as claimed in claim 13, wherein the first object to be connected is a card-type electronic component, and the second object to be connected is a substrate.

15. The connector as claimed in claim 13, wherein said accommodating portion is a hole extending through said bottom portion in the direction of the height of said housing, and wherein when the first object to be connected is disposed on said bottom portion, thereby causing the first object to be connected to be brought into contact with said contact portion to elastically deform said pair of spring portions, said pair of spring portions are not brought into contact with the second object to be connected.

16. The connector as claimed in claim 15, wherein the first object to be connected is a card-type electronic component, and the second object to be connected is a substrate.

17. The connector as claimed in claim 15, wherein the contact portion is located in one area on one side of a plane, as a boundary, which extends through a holding portion-side end of one of said pair of spring portions and a holding portion-side end of the other of said pair of spring portions and is parallel with the direction of the height of said housing, and curved portions of said pair of spring portions are located in another area on another side of the plane, such that said curved portions of said pair of spring portions are lifted toward the first object to be connected when the first object to be connected is disposed on said bottom portion, thereby causing the first object to be connected to be brought into contact with said contact portion to elastically deform said pair of spring portions.

18. The connector as claimed in claim 17, wherein the first object to be connected is a card-type electronic component, and the second object to be connected is a substrate.

19. The connector as claimed in claim 1, wherein said housing has a bottom portion opposed to a disposing surface of the first object to be connected, wherein said bottom portion is formed with an accommodating portion for accommodating said pair of spring portions in a displaceable manner, wherein when the first object to be connected is not disposed on said bottom portion, said contact portion protrudes from said accommodating portion, whereas when the first object to be connected is disposed on said bottom portion, said contact portion is pushed in toward said accommodating portion, and wherein when the first object to be connected is disposed on said bottom portion, thereby causing the first object to be connected to be brought into contact with said contact portion to elastically deform said pair of spring portions, said pair of spring portions are not brought into contact with the first object to be connected.

20. The connector as claimed in claim 19, wherein the first object to be connected is a card-type electronic component, and the second object to be connected is a substrate.

21. The connector as claimed in claim 19, wherein said accommodating portion is a hole extending through said bottom portion in the direction of the height of said housing, and wherein when the first object to be connected is disposed on said bottom portion, thereby causing the first object to be connected to be brought into contact with said contact portion to elastically deform said pair of spring portions, said pair of spring portions are not brought into contact with the second object to be connected.

22. The connector as claimed in claim 21, wherein the first object to be connected is a card-type electronic component, and the second object to be connected is a substrate.

23. The connector as claimed in claim 21, wherein the contact portion is located in one area on one side of a plane, as a boundary, which extends through a holding portion-side end of one of said pair of spring portions and a holding portion-side end of the other of said pair of spring portions and is parallel with the direction of the height of said housing, and curved portions of said pair of spring portions are located in another area on another side of the plane, such that said curved portions of said pair of spring portions are lifted toward the first object to be connected when the first object to be connected is disposed on said bottom portion, thereby causing the first object to be connected to be brought into contact with said contact portion to elastically deform said pair of spring portions.

24. The connector as claimed in claim 23, wherein the first object to be connected is a card-type electronic component, and the second object to be connected is a substrate.

* * * * *